US008548525B2

(12) United States Patent
Wong et al.

(10) Patent No.: US 8,548,525 B2
(45) Date of Patent: Oct. 1, 2013

(54) SYSTEMS AND METHODS USING ANTENNA BEAM SCANNING FOR IMPROVED COMMUNICATIONS

(75) Inventors: Piu Bill Wong, Causeway Bay (CN); Hang Ching Jason Leung, Yuen Long (HK); Chun Kit Chan, Tseung Kwan O (CN)

(73) Assignee: FiMax Technology Limited, George Town, Grand Cayman (KY)

( * ) Notice: Subject to any disclaimer, the term of this patent is extended or adjusted under 35 U.S.C. 154(b) by 1603 days.

(21) Appl. No.: 11/770,559

(22) Filed: Jun. 28, 2007

(65) Prior Publication Data

US 2009/0005121 A1 Jan. 1, 2009

(51) Int. Cl.
*H01Q 3/26* (2006.01)

(52) U.S. Cl.
USPC ..... 455/562.1; 455/550.1; 455/561; 455/575.7; 455/63.4; 370/329; 343/754

(58) Field of Classification Search
USPC ..... 455/25, 63.1, 63.4, 67.11, 67.13, 455/67.16, 91, 101, 134, 135, 137, 226.1, 455/226.2, 226.3, 276.1, 277.2, 561, 562.1; 375/144, 146, 148, 267; 342/81, 82, 350, 342/354, 367, 368; 343/751, 757, 754; 370/310, 328, 329, 331, 332, 334
See application file for complete search history.

(56) References Cited

U.S. PATENT DOCUMENTS

| | | | | |
|---|---|---|---|---|
| 2,627,069 | A * | 1/1953 | Huber et al. | 342/144 |
| 6,167,286 | A * | 12/2000 | Ward et al. | 455/562.1 |
| 6,233,466 | B1 | 5/2001 | Wong et al. | |
| 6,429,822 | B1 * | 8/2002 | Naudin et al. | 343/754 |
| 7,177,644 | B2 * | 2/2007 | Smith et al. | 455/445 |
| 7,289,828 | B2 * | 10/2007 | Cha et al. | 455/562.1 |
| 7,359,735 | B2 * | 4/2008 | Fujishima et al. | 455/562.1 |
| 7,366,464 | B2 * | 4/2008 | Iacono et al. | 455/25 |
| 7,587,173 | B2 * | 9/2009 | Hoffmann et al. | 455/63.4 |
| 7,610,064 | B2 * | 10/2009 | Mohamadi | 455/561 |
| 7,640,035 | B2 * | 12/2009 | Jang et al. | 455/551 |
| 8,373,582 | B2 * | 2/2013 | Hoffberg | 340/995.13 |
| 2004/0053634 | A1 * | 3/2004 | Gainey et al. | 455/522 |
| 2005/0110583 | A1 | 5/2005 | Song et al. | |
| 2005/0254442 | A1 | 11/2005 | Proctor et al. | |
| 2005/0255892 | A1 | 11/2005 | Wong et al. | |
| 2005/0285803 | A1 | 12/2005 | Iacono et al. | |
| 2006/0164969 | A1 * | 7/2006 | Malik et al. | 370/203 |
| 2006/0182077 | A1 | 8/2006 | Scherzer et al. | |
| 2007/0223402 | A1 * | 9/2007 | Waxman | 370/277 |
| 2008/0225758 | A1 | 9/2008 | Proctor et al. | |
| 2008/0267063 | A1 * | 10/2008 | Trigui et al. | 370/229 |

FOREIGN PATENT DOCUMENTS

| | | |
|---|---|---|
| WO | WO-2005/089384 | 9/2005 |
| WO | WO-2005/122328 | 12/2005 |
| WO | WO-2006/034194 | 3/2006 |

OTHER PUBLICATIONS

International Search Report and the Written Opinion issued for PCT/IB2008/003577, dated May 14, 2009; 7 pages.

* cited by examiner

*Primary Examiner* — Mahendra Patel
(74) *Attorney, Agent, or Firm* — Fulbright & Jaworski LLP

(57) ABSTRACT

Systems and methods which utilize antenna pattern or antenna beam scanning techniques to provide communication of payload traffic are shown. A base station radio is provided wireless communication links with a plurality of stations for communication of payload traffic between the base station and stations using a succession of antenna patterns. The antenna patterns are scanned in succession, such as randomly, quasi-randomly, sequentially, or according to a schedule. An antenna pattern scheduler may be used to implement antenna pattern scanning and traffic timing. Cooperative scheduling with respect to a plurality of base stations may be provided. Selection of the plurality of antenna patterns used by a base station is preferably adjusted from time to time, such as based upon environment, usage patterns, etcetera.

60 Claims, 4 Drawing Sheets

SYSTEMS AND METHODS USING ANTENNA BEAM SCANNING FOR IMPROVED COMMUNICATIONS

TECHNICAL FIELD

The present invention relates generally to wireless communications and, more particularly, to use of antenna beam scanning to facilitate desired wireless communications.

BACKGROUND OF THE INVENTION

Communications through wireless communication links has become quite common in recent years due to such considerations as improved radio technologies and modulation techniques, reduced cost of infrastructure deployment, and support for station mobility. However, the providing of wireless communications is not without challenges and tradeoffs. For example, wireless communication links are often susceptible to interference (both from other stations within the communication network and sources external to the communication network), provide a limited service area, and often experience reduced capacity in accommodating station, mobility.

Many wireless communication systems, for example, have utilized omni-directional antenna patterns or antenna beams in order to provide wireless communication links throughout a service area. However, such omni-directional antenna patterns are highly susceptible to interference and typically introduce interfering signals to other systems. Moreover, the area serviced by such omni-directional antenna patterns is often relatively small in radius due to the gain available from antenna systems providing omni-directional antenna patterns. Capacity issues, such as resulting from the aforementioned interference, and limitations on the size of the service area often necessitate increased numbers of base stations, and thus increased costs and complexity, in an omni-directional system configurations.

Wireless communication systems have, more recently, adopted directional antenna beam configurations. Such directional antenna beam configurations may typically be used to decrease interference and to potentially extend the range of a base station. However, directional antenna beam configurations are often highly complex and costly, both in initial infrastructure cost as well as communication and processing costs.

For example, directional antenna configurations often require a radio for use with each directional active antenna beam formed, thus often necessitating a relatively large number of radios to provide communications within a large service area. Moreover, in order to form the appropriate directional beams the base station must have very accurate channel state information, thus utilizing appreciable overhead for channel state information feedback from the stations (e.g., multiple subscriber stations operating within the service area). Subscriber stations must often be provided with sophisticated algorithms and circuitry for collecting the channel state information necessary for implementing proper directional antenna patterns. The time required for a station to collect and communicate the channel state information to a base station can result in the channel state information available at the base station being relatively old. In a highly mobile environment or a fast fading environment such outdated information can be insufficient for proper control of directional antenna patterns. Assuming appropriate channel state information is available at a base station, substantial processing power is typically required to analyze the channel state information and to derive the beam forming parameters to provide a directional antenna pattern optimized for the channel state. Where multiple stations are provided communications simultaneously, the overhead and processing requirements can be daunting.

Accordingly, the various wireless communication systems available today have not been found by the inventors of the present invention to provide an ideal mix of service area coverage, system capacity, and low cost.

BRIEF SUMMARY OF THE INVENTION

The present invention is directed to systems and methods which utilize antenna pattern or antenna beam scanning (e.g., forming antenna patterns and processing antenna beam signals in a scanning sequence) techniques to provide communication of payload traffic (e.g., data packets). A base station radio (e.g., transceiver) is provided wireless communication links with a plurality of stations (e.g., subscriber stations) for communication of payload traffic between the base station and stations using a succession of antenna patterns according to embodiments of the invention. The wireless communication links are preferably provided through the use of a plurality of directional antenna patterns which are chosen from a superset of predefined antenna patterns available at the base station. The plurality of directional antenna patterns are scanned in succession, such as randomly, quasi-randomly, sequentially, or according to a schedule (e.g. timed, weighted, etcetera), to provide communications throughout the service area with the stations disposed therein. The use of predefined antenna patterns reduces processing requirements and delays associated with forming antenna patterns for use in providing communications, while facilitating the use of directional antenna patterns providing advantages with respect to interference, capacity, range, etcetera.

In operation according to a preferred embodiment, neither detailed nor perfect channel state information is required from the stations in order to utilize directional antenna patterns. For example, as the base station scans the directional antenna patterns forming the currently chosen plurality of directional antenna patterns, stations may provide information identifying a best (e.g., highest signal to interference ratio (SIR), highest receive signal strength indicator (RSSI), lowest bit error rate (BER), etcetera) one of the directional antenna patterns for use with that station, such as through the use of a ranging protocol. Feedback of antenna pattern selection information requires less overhead and can be accomplished more expeditiously than feedback of complete channel state information required to uniquely form a directional antenna pattern for a station.

Embodiments of the invention utilize an antenna pattern scheduler to implement antenna pattern scanning and traffic timing. For example, an antenna pattern scheduler of embodiments of the invention invokes a desired succession of antenna patterns for the base station and ensures that data packet transmission and reception associated with stations for which each particular antenna pattern has been selected coincide with the antenna pattern succession. Antenna pattern schedulers may invoke algorithms to control the succession of antenna patterns, the active times of antenna patterns, the periodicity or repetition of particular antenna patterns, etcetera in order to provide various features or benefits. For example, desired quality of sendee (QoS) may be facilitated with respect to one or more station by an antenna pattern scheduler of an embodiment of the invention, such as by more frequent scheduling of an antenna pattern determined to be best with respect to the station for which a high QoS is desired. An antenna pattern scheduler may control scanning of the antenna patterns such that the illumination (as may be provided by one or more antenna beams) time of one or more portions of a service area associated with higher traffic is greater than the illumination times of other portions of the service area, thereby providing increased throughput. Additionally or alternatively, intra-network interference mitigation may be facilitated through antenna pattern succession control by an antenna pattern scheduler of an embodiment of the invention.

Cooperative scheduling with respect to a plurality of base stations is provided according to embodiments of the invention. For example, a network scheduler (e.g., a master one of the aforementioned antenna pattern schedulers coupled to antenna pattern schedulers of other base stations or a centralized scheduler coupled to the antenna pattern schedulers of base stations) may be used to coordinate the succession of antenna patterns for a plurality of base stations in a communication network. By coordinating the antenna pattern successions, intra-network interference may be avoided, such as by selection of antenna patterns for use at adjacent base stations, or base stations within line of sight of each other, which do not result in interference (e.g., non-overlapping, have orthogonal attributes, do not present wave fronts directed at one another, etcetera).

Selection of the plurality of directional antenna patterns used by a base station is preferably adjusted from time to time, such as based upon environment, usage patterns, etcetera. For example, an initial subset of directional antenna patterns may be chosen from the superset of predefined antenna patterns available at the base station as a set of antenna patterns commonly found to provide adequate communications, a set of antenna patterns likely to provide desired operation with respect to an expected operational environment, etcetera. Such an initial selection may, for example, provide an even distribution of directional antenna patterns azimuthally about a base station location. However, in operation of the particular base station it may be discovered that user stations and/or communications loading is not uniformly distributed throughout the sendee area. A controller of the present invention may operate to adapt selection of the directional antenna patterns so as to provide fewer, perhaps broader beam, antenna patterns covering the less used portions of the service area and more, perhaps narrower beam, antenna patterns covering the more used portions of the service area. Accordingly, lime scanning and/or serving less used portions of the service area may be minimized while time scanning and/or seizing more used portions of the service area may be increased, thus providing increased capacity and performance.

Embodiments of the present invention provide scheduling of communications using the aforementioned succession of antenna patterns to optimize service area coverage and system capacity. Through the use of a one data stream (it being understood that such a data stream my comprise a multiple access data stream carrying data associated with a plurality of nodes) to many antenna pattern configuration, and by leveraging the use of directional antenna patterns to reduce interference while increasing service area coverage and/or system capacity, embodiments of the present invention provide a relatively low cost solution, both in equipment costs and control overhead and processing costs.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying FIGS. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 1:
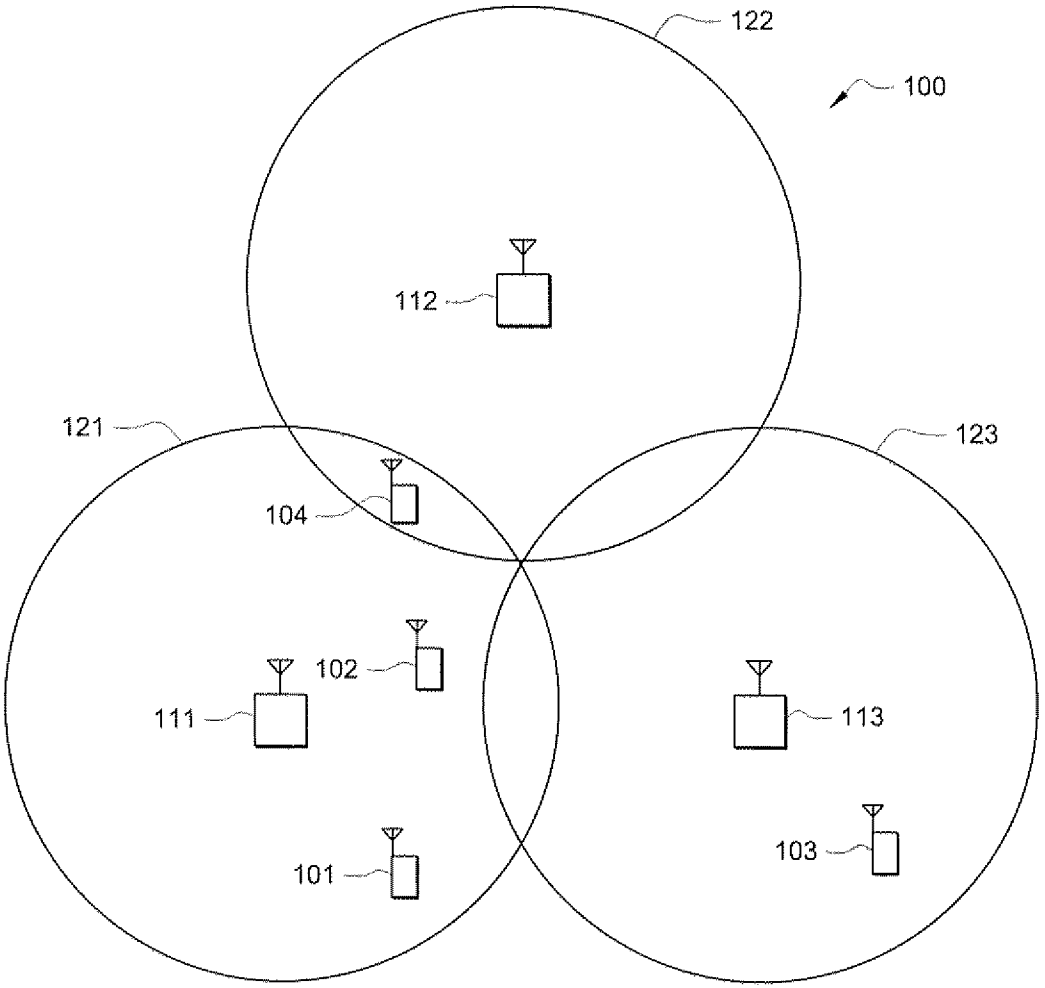
FIG. 1 shows a wireless communication system adapted according to an embodiment of the invention.

FIG. 1 shows wireless communication system 100 adapted according to an embodiment of the present invention. Wireless communication system 100 of the illustrated embodiment includes a plurality of base stations, shown as base stations 111-113, providing wireless communications with respect to a plurality of subscriber stations, shown as subscriber stations 101-104. Specifically, each of base stations 111-113 provides wireless communications within a corresponding one of service areas 121-123. Accordingly, subscriber stations 101-104 may be disposed at any position within service areas 121-123 and operation of wireless communication system 100 may provide wireless links thereto.

It should be appreciated that, although the embodiment of FIG. 1 shows wireless communication system 100 comprising a plurality of base stations in order to facilitate discussion of features of various embodiments, concepts of the present invention may be implemented with respect to different configurations of wireless communication systems. For example, embodiments of the invention adapt a single base station to provide improved wireless communications in accordance with concepts described herein.

Subscriber stations utilized according to embodiments of the invention may be provided in a number of configurations. For example, subscriber stations 101-104 may comprise mobile devices, such as laptop computers, table computers, personal digital assistants (PDAs), cellular telephones, pagers, vehicles, etcetera, and/or stationary devices, such as desktop computers, point of sale (POS) terminals, appliances, utility meters, etcetera. Such stations need only be adapted to operate as described herein, such as to operate in accordance with a ranging protocol for antenna pattern selection.

Figure 2:
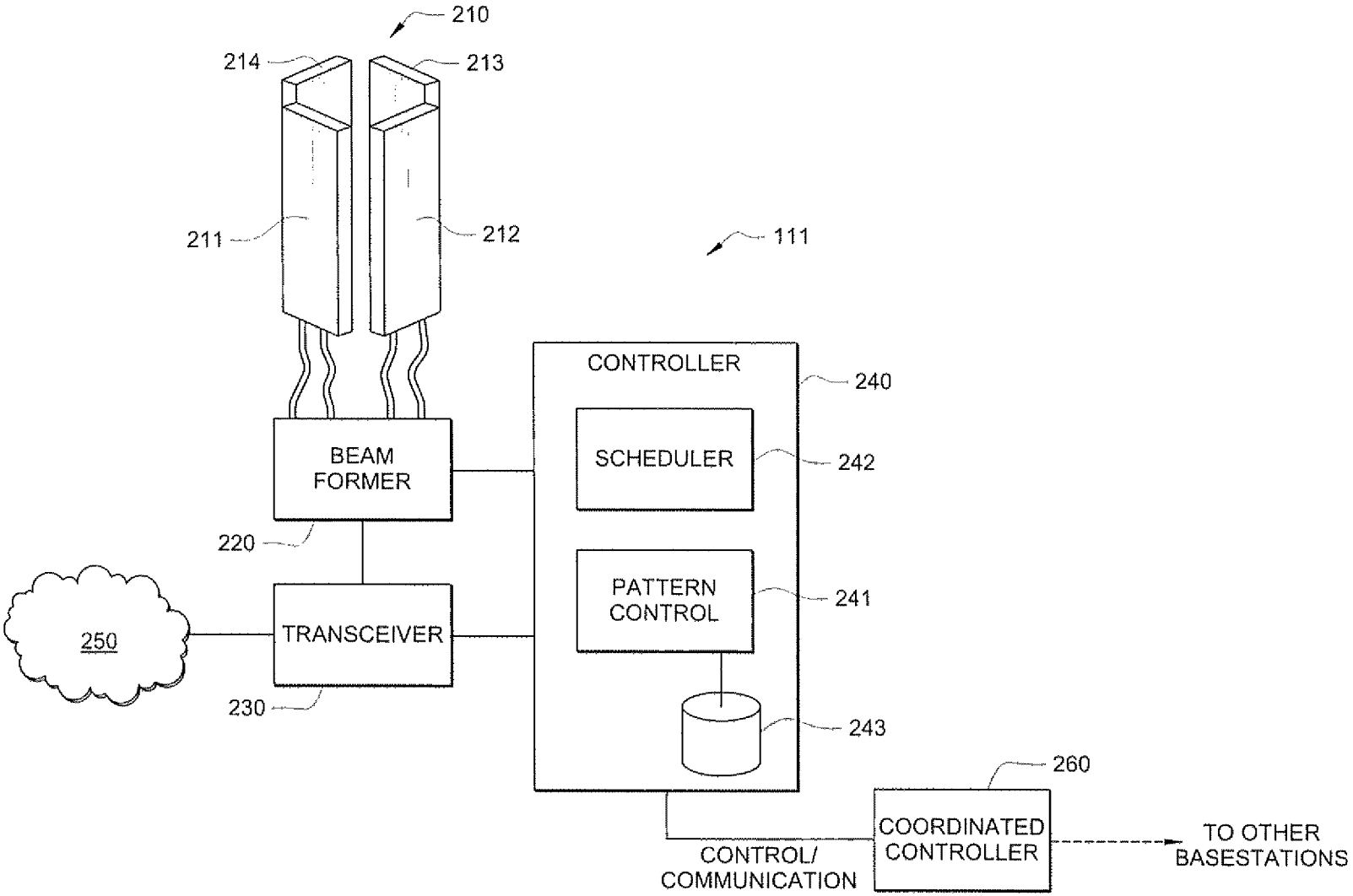
FIG. 2 shows detail with respect to a base station of the communication system of FIG. 1 according to an embodiment of the invention.

Directing attention to FIG. 2, detail with respect to a base station adapted according to an embodiment of the present invention is shown. Specifically, detail with respect to base station 111 of FIG. 1 is shown. It should be appreciated that base stations 112 and 113 may be similarly configured.

Base station 111 illustrated in FIG. 2 includes antenna array 210 coupled to transceiver 230 through beam former 220. Antenna array 210 preferably includes a plurality of antenna elements, such as may comprise monopole, dipole, patch, and/or other well known radio frequency (RF) transducers, disposed in a predetermined configuration to provide operation as a phased array. Various antenna elements utilized according to embodiments of the present invention may have different attributes, such as different polarization, gain, orientation, etcetera, if desired.

Although the illustrated embodiment shows 4 antenna array panels, shown as antenna array panels 211-214, it should be appreciated that various antenna array configurations, including curved, circular, and conical, having any number of panels may be utilized according to embodiments of the invention. Generally, the larger the number of antenna elements provided with respect to the phased array, the larger the number of antenna patterns available and/or the more well defined the antenna patterns may be. However, the more antenna elements that are available for separate antenna pattern forming control, the more complex the beam forming network becomes. Accordingly, a tradeoff is anticipated for any particular system configuration in order to provide a desired level of antenna pattern forming control and an acceptable level of system complexity and cost. Any antenna configuration which provides the desired antenna patterns as described herein may be utilized according to various embodiments of the invention.

Beam former 220 of embodiments provides a phase shifting network for communication of a signal (e.g., data stream signal) associated with transceiver 230 within desired antenna patterns. For example, beam former 220 may couple a transceiver signal interface to a plurality of individual signal paths, each associated with an antenna element or antenna element column of antenna array 210, Each such beam former signal path, may comprise an adjustable phase shifter, adjustable attenuator, and/or adjustable amplifier. Additionally or alternatively, beam former 220 may implement a digital signal processor (DSP), perhaps in combination with analog to digital (A/D) and/or digital to analog (D/A) converters, or other digital processing means, such as a processor-based system operable under control of an instruction set to provide processing of digital signals, to provide digital beam forming. Regardless of whether signals are processed using analog and/or digital, circuitry of beam former 220, a signal output by transceiver 230 may be provided to antenna elements disposed azimuthally around antenna array 210 with proper relative phases and weighting to form desired antenna patterns when radiated by the excited antenna elements (e.g., sufficient to form one or more wave fronts directed in desired directions, having one or more nulls directed in desired directions, having a desired beam width, providing a desired gain, etcetera). Similarly, signals received by antenna elements disposed azimuthally around antenna array 210 may be provided to antenna array interfaces of beam former 220 such that the antenna signals are processed such that an antenna beam signal is output to transceiver 230.

From the above, it should be appreciated that, although a single line is shown connecting each of antenna array panels 211-214 to beam former 220, multiple signal paths may be provided between each such antenna array panel and beam former 220. For example, a signal path for each antenna element or antenna element column of antenna element panels 211-214 may be provided between the antenna element panels and beam former 220. Embodiments of the present invention dispose beam former 220 in close proximity to antenna array 210, such as at the top of an antenna mast with antenna array 210, in order to avoid long runs of a large number of cables carrying the antenna array signals. However, beam former 220 may be disposed in any practicable location, such as within an enclosure with transceiver 230, if desired. The antenna array signals may be converted to digital signals for such transmission and/or beam forming, if desired.

Controller 240 of the illustrated embodiment is coupled to beam former 220 and transceiver 230 to provide control thereto and/or receive information therefrom. Controller 240 may comprise any suitable form of control system, such as may comprise a processor-based system operating under control of an instruction set, a programmable gate array (PGA), an application specific integrated circuit (ASIC), etcetera, operable to provide control as described herein.

Transceiver 230 of embodiments preferably provides for reception and transmission of RF and baseband signals. Accordingly, transceiver 230 may be utilized to place subscriber stations in communication with other devices coupled to transceiver 230, such as through network 250. Of course, one or more system to be placed in communication with subscriber stations (e.g., a computer, a server, a peripheral device, etcetera) may be coupled directly to network 250.

Transceiver 230 of the illustrated embodiment provides communication according to one or more standardized protocols. For example, transceiver 230 may comprise a radio or radio chip set operable to provide communications according to the IEEE 802.11 (commonly referred to as WiFi) and/or 802.16 (commonly referred to as WiMAX and WiBro) standards. Accordingly, transceiver 230 may comprise a conventional radio or radio chip set, which when utilized in a base station adapted according to embodiments of the present invention realizes improved communications.

As can be seen in the illustrated embodiment, transceiver 230 is coupled in a one to many relationship with respect to antenna patterns formed by antenna array 210. That is, transceiver 230 may be utilized to provide substantially simultaneous (e.g., perceived by a user as simultaneous) communications for a plurality of subscriber stations using a plurality of antenna patterns and a multiple access protocol (e.g., WiFi, WiMAX, WiBro, etcetera). Through the use of the aforementioned multiple antenna patterns, interference may be reduced and capacity may be increased.

The foregoing base station components may be provided in a number of configurations, such as in an embedded configuration or a separated configuration. For example a separated configuration may be provided wherein the antenna array, beam former, and controller are separate from the transceiver in order to facilitate flexibility with respect to coupling different antenna/base station combinations. According to one embodiment, by standardizing the transceiver control interface, different transceiver types, such as WiFi, WiMAX, and WiBro base stations, can be connected with different antenna configurations (e.g., different number of sectors, different number of antenna elements, different antenna gain, etcetera). Such an embodiment provides flexibility for different deployment scenarios.

Another separated configuration may be provided wherein the antenna array and beam former are separate from the controller and transceiver. Again, by standardizing the control interface, different base station types, such as WiFi, WiMAX, and WiBro base stations, can be connected with different antenna configurations. In addition, the beam control connection can also be embedded in the RF connection in order to reduce deployment difficulties.

An embedded configuration of embodiments, wherein the antenna array, the beam former, the controller, and the transceiver are integrated into a same unit, provides a less complex deployment as no further connection would be needed to interface the antenna structure with the base station unit. In order to provide options for different deployment scenarios, the integrated base station unit may actually be multi-mode, such as to be both WiFi and WiMAX enabled. Accordingly, antenna array may be multi-mode, preferably having independent beam control units which support separate antenna pattern formation for the WiFi and WiMAX systems. Moreover, embodiments may include special algorithms for handling handoff between these multiple modes, such as to provide load balancing and/or satisfy other business logic.

Referring still to FIG. 2, network 250 may be any form of network according to embodiments of the invention. For example, network 250 may comprise the public switched telephone network (PSTN), the Internet, an intranet, an extranet, a local area network (LAN), a metropolitan area network (MAN), a wide area network (WAN), a wireless network, and/or combinations thereof. Network 250 may be utilized to provide communication of traffic associated with the subscriber stations, communication of control information associated with the base stations, etcetera.

In the embodiment illustrated in FIG. 2, base station 111 is coupled to coordinated controller 260. Coordinated controller 260 may comprise any suitable form of control system, such as may comprise a processor-based system operating under control of an instruction set, a PGA, an ASIC, etcetera, operable to provide control as described herein. According to embodiments of the invention, coordinated controller 260 provides cooperative control of antenna pattern scanning (e.g., forming antenna patterns for processing antenna beam signals in a scanning sequence) between a plurality of base stations, such as base stations 111-113. Communication between coordinated controller 260 and various ones of the base stations may be provided via network links, such as using network 250, and/or via dedicated signal paths.

Although coordinated controller 260 is shown separate from base station 111 in the illustrated embodiment, it should be appreciated that the functionality of coordinated controller 260 may be integrated into a base station, such as within controller 240. For example, controller 240 of base station 111 may provide a "master" controller for coordinating a plurality of base stations.

Figure 3:
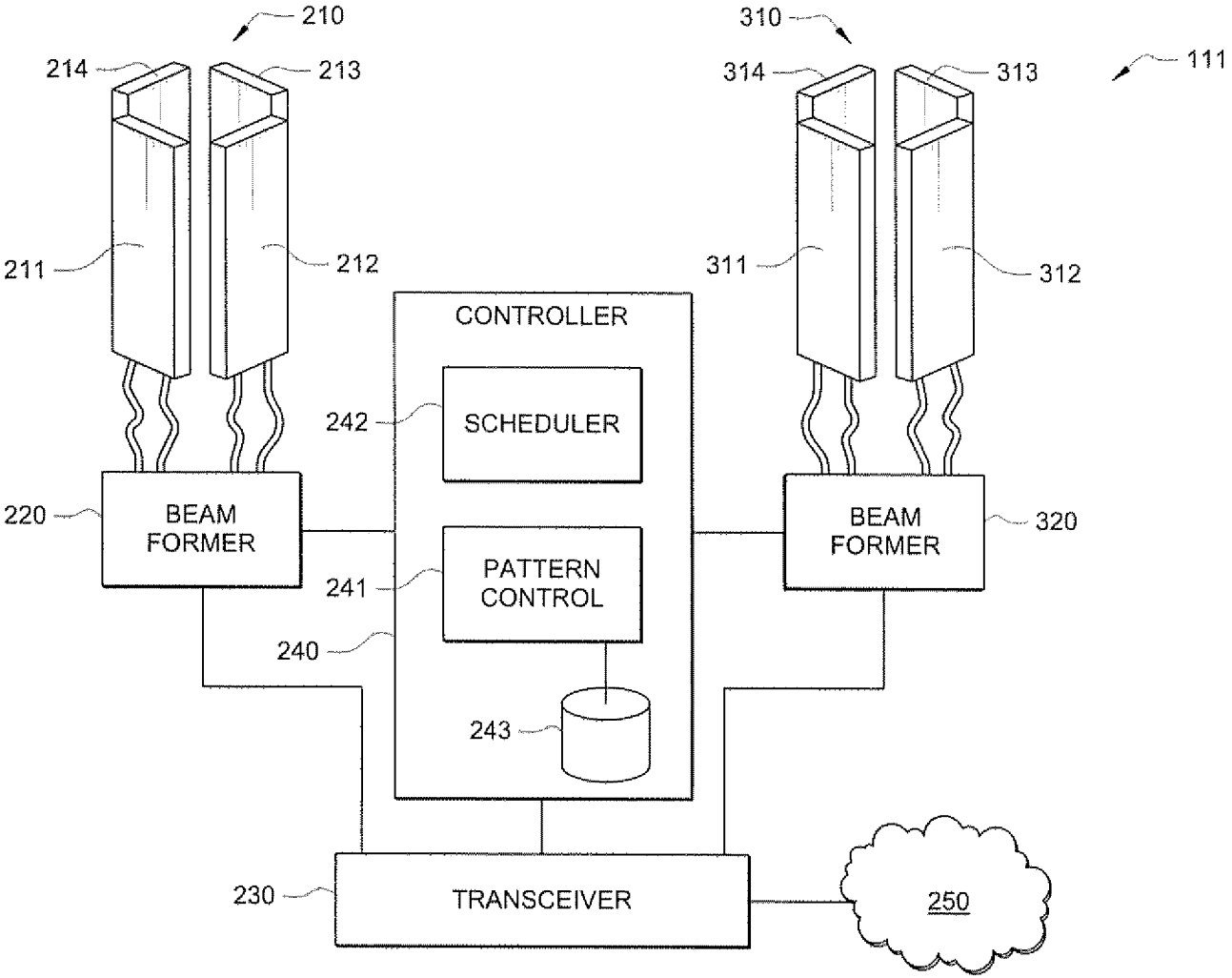
FIG. 3 shows detail with respect to an alternative embodiment base station configuration of the communication system of FIG. 1.

It should be appreciated that various configurations of base stations may be utilized according to embodiments of the invention. For example, embodiments implementing a plurality of antenna arrays (e.g., 2, 3, 4, etcetera) may be utilized according to the present invention. Directing attention to FIG. 3, an embodiment wherein base station 111 is implemented in a dual antenna array configuration is shown. Specifically, base station 111 of FIG. 3 includes antenna array 310, having antenna array panels 311-314, in addition to antenna array 210. Antenna array 310 of the illustrated embodiment is coupled to transceiver 230 through beam former 320. Antenna array 310 and beam former 320 are preferably configured and operated as described above with respect to antenna array 210 and beam former 220.

Antenna array 310 may be utilized to provide diversity, such as spatial diversity and/or polarization diversity, multiple-input-multiple-output (MIMO) communications, etcetera. For example, transceivers used in providing WiFi access points are typically configured to include two antenna ports for spatial diversity. Transceivers used in providing WiMAX access points are often configured to include multiple antenna ports for MIMO operation. Transceiver 230 of FIG. 3 may comprise such transceiver configurations, thereby facilitating the use of antenna arrays 210 and 310.

Base stations 111-113 of preferred embodiments of the invention utilize antenna pattern or antenna beam scanning techniques to provide communication of pay load traffic to and from subscriber stations 101-104 and/or to and from other ones of base stations 111-113. For example, transceiver 230 of base station 111 is provided wireless communication links with subscriber stations 101, 102, and 104 for communication of payload traffic between base station 111 and subscriber stations 101, 102, and 104 using a succession of antenna patterns according to embodiments of the invention. The antenna patterns preferably provide illumination of differing portions of service area 121 associated with base station 111 and may be overlapping (with respect to their footprint in the service area), non-overlapping, or a combination of overlapping and non-overlapping antenna patterns.

The wireless communication links are preferably provided through the use of a plurality of directional antenna patterns which are selected from a superset of predefined antenna patterns available at the base station. For example, base station 111 may be configured to provide a superset of 1000 or more antenna patterns stored within database 243 (FIG. 2) having various different attributes (e.g., centered upon different azimuthal angles, having different beam widths, providing different levels of gain, having nulls directed along different azimuthal angles, etcetera) and a subset of this superset of available antenna patterns (e.g., 4-20 antenna patterns) are preferably selected as the antenna patterns for scanning.

An initial subset of directional antenna patterns may be chosen from the superset of predefined antenna patterns available at the base station based on various criteria. For example, a set of antenna patterns commonly found to provide adequate communications may initially be selected. Alternatively, a set of antenna patterns thought likely to provide desired operation with respect to an expected operational environment may initially be selected. According to one embodiment, a network operator or other entity may provide information with respect to subscriber station distribution and/or traffic loading so that an initial selection of antenna patterns and scheduling plan may be tailored to the expected environment. Thus, various narrow and/or wide antenna patterns may be selected from database 243 for directing to particular portions of service area 121 and the initial scheduling plan invoked by scheduler 242 may be adapted to facilitate desired throughput. QoS, etcetera.

Figure 4:
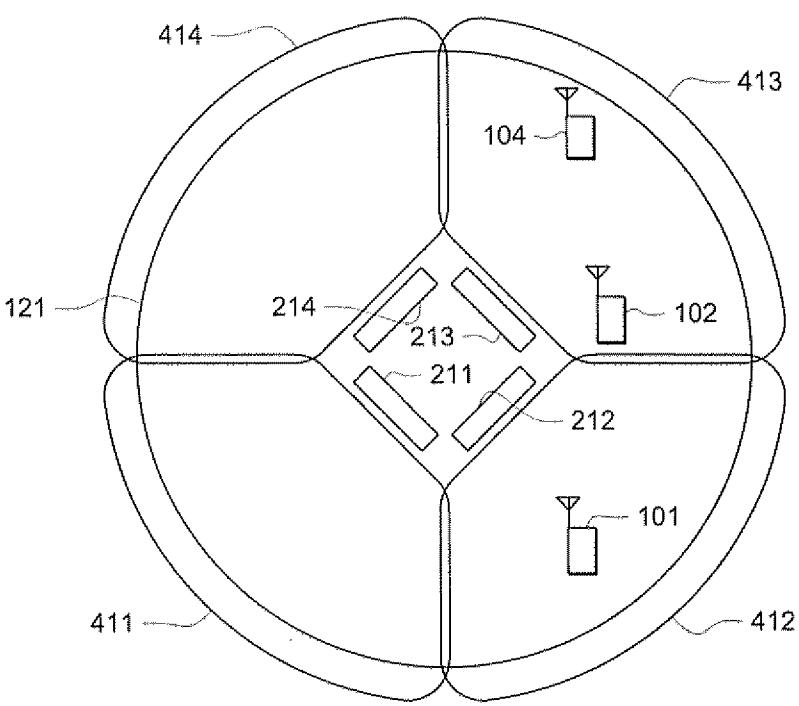
FIG. 4 shows an exemplary set of antenna patterns selected for scanning according to an embodiment of the invention.

A highly simplified representation of a plurality of antenna patterns selected for scanning is shown in FIG. 4. In the embodiment of FIG. 4, 4 substantially 90° antenna patterns, shown as antenna patterns 411-414, have been selected for scanning from all of the antenna patterns available in database 243. For example, phase shift and signal weighting information for signal paths of beam former 220 suitable for forming particular antenna patterns may be obtained from database 243 by pattern control 241 for use in controlling components of beam former 220 to provide antenna patterns 411-414. It should be appreciated that antenna patterns 411-414 together provide illumination of service area 121.

A "best" antenna pattern of the antenna patterns currently selected for scanning is preferably chosen for communications with each subscriber station for which communications are desired. One or more ranging protocols may be implemented in order to initially choose a best antenna pattern for each subscriber station as well as to update or revise the choices. For example, as base station 111 scans the antenna patterns forming the antenna patterns currently selected for scanning, the subscriber stations may monitor base station transmission and/or transmit packets in order to provide information (e.g., antenna pattern choice information) identifying a best (e.g., highest signal to interference ratio (SIR), highest receive signal strength indicator (RSSI), lowest bit error rate (BER), etcetera) one of the antenna patterns for use with that subscriber station. This information is preferably processed by controller 240 to facilitate scheduling and antenna pattern control as described herein.

Scheduler 242 of the illustrated embodiment implements antenna pattern scanning and traffic timing by controlling the succession, of antenna patterns, active times of antenna patterns, periodicity or repetition of particular antenna patterns, etcetera. For example, scheduler 242 of embodiments communicates with pattern control 241 to invoke a desired succession of antenna patterns selected for scanning (in the foregoing example, antenna patterns 411-414). Scheduler 242 further communicates with transceiver 230 to receive information identifying a best antenna pattern for the subscriber stations and to provide timing control, with respect to data packets. According to embodiments of the invention, such timing control may comprise controlling transceiver 230 to transmit appropriate data packets at the appropriate time (e.g., transmit data packets directed a particular subscriber station when that subscriber station's best antenna pattern is active) and/or controlling pattern control 241 and beam former 220 to activate an appropriate antenna pattern at the appropriate time (e.g., activate a particular subscriber station's best antenna pattern when data packets directed to that subscriber station are being transmitted).

Although scheduling plans invoked by scheduler 242 of embodiments of the invention may be homogeneous (e.g., each selected antenna pattern is implemented in series for a same illumination time period), embodiments of the present invention invoke non-homogeneous antenna pattern scheduling plans (e.g., where one or more antenna pattern is implemented more frequently in a series and/or one or more antenna pattern is implemented for a longer/shorter illumination time period). For example, quality of service (QoS) provided with respect to various subscriber stations may be controlled by scheduler 242 through more/less frequent scheduling of an antenna pattern determined to be best with respect to the station for which a high/low QoS is desired. Additionally or alternatively, scheduler 242 may control scanning of the antenna patterns such that the illumination time of one or more portions of a service area associated with higher/lower traffic is greater/less than the illumination times of other portions of the service area. For example, an antenna pattern illuminating an area densely populated with subscriber stations or having more dense communication traffic may be allowed to remain active a longer time (antenna pattern active period) in the scanning sequence and/or may be repeated more often in the scanning sequence (antenna pattern active frequency). Similarly, overlapping antenna patterns which provide illumination of an area densely populated with subscriber stations may be used cooperatively in the scanning sequence invoked by scheduler 242 in order to provide increased illumination time with respect to a particular portion of the service area.

In operation according to a preferred embodiment, the antenna patterns selected for scanning are scanned in succession under control of controller 240 to provide communications throughout the service area associated with a base station. For example, base station 111 may successively form each of antenna patterns 411-414 in order to provide communications to/from each of subscriber stations 101, 102, and 104 as well as to monitor all portions of sendee area 121 for initiation of communications by other subscriber stations. The order in which the selected antenna patterns are formed may be random, quasi-random (e.g., scanning antenna patterns 411-414 in the following order: 411, 413, 412, 414, 413, 412, 411 . . . ), sequentially (e.g., scanning antenna patterns 411-414 in the following order: 411, 412, 413, 414, 411, 412 . . . ), or according to a defined schedule. For example, a schedule may be defined in which used of one or more antenna patterns is weighted (e.g., scanning antenna patterns 411-414 in the following order, where each entry in the list is associated with a uniform active period: 411, 412, 412, 413, 414, 411, 412, 412 . . . ) in order to provide weighted illumination of particular subscriber stations for facilitating a desired quality of service (QoS). Additionally or alternatively, a schedule may be defined in order to provide timed synchronization of antenna patterns to facilitate communications. Random or quasi-random antenna pattern scanning may be preferred according to embodiments in order to provide time averaged mitigation of interference experienced by other systems (e.g., other base stations and/or subscriber stations in the wireless communication system).

Depending upon the configuration of the antenna patterns then selected for scanning and the current disposition of subscriber stations within the service area, one or more subscriber stations may be provided communication links via the same antenna pattern. Accordingly, a same antenna pattern may be shared as a "best" antenna pattern for a plurality of subscriber stations. Such sharing of antenna patterns may be factored into the aforementioned scheduling such that the duration an antenna pattern is active in a scan iteration may be proportional to the number of subscriber stations for which the particular antenna pattern has been selected as the best antenna pattern (e.g., scanning antenna patterns 411-414 in the following order, where each entry in the list is associated with a uniform active period: 411, 412, 413, 413, 414, 411, 412, 413, 413, . . . ).

As will be appreciated from the discussion below, although two subscriber stations may be disposed in the same or nearly the same position within a service area, embodiments of the present invention may operate to choose different antenna patterns as "best" antenna patterns for use with each such subscriber station. Accordingly, subscriber stations disposed in nearly the same position may be provided communication links via different antenna patterns according to embodiments of the present invention.

Intra-network interference mitigation is preferably facilitated through antenna pattern succession control by antenna pattern schedulers of embodiments of the invention. As discussed above, random or quasi-random antenna pattern scanning may be utilized to provide time averaged mitigation of interference experienced by other systems. However, such random or quasi-random antenna pattern scanning may not provide a desired level of intra-network interference in some scenarios and/or may not be readily implemented in certain systems (e.g., quasi-random scheduling of antenna patterns is not possible because associated timing control of data packet transmission is unavailable). Accordingly, embodiments of the invention implement cooperative scheduling with respect to base stations 111-113. For example, coordinated controller 260 (FIG. 2) of embodiments is coupled to each of base stations 111-113 and is configured as a network scheduler to coordinate the succession of antenna patterns for each of base stations 111-313. By coordinating the antenna pattern successions, intra-network interference may be avoided. For example, coordinated controller 260 may cause controllers 240 at each of base stations 111-113 to select an antenna pattern facing south-east (e.g., antenna pattern 412 of FIG. 4) during an epoch so as to cause each base station to utilize an antenna pattern which does not result in interference or which minimizes interference.

It should be appreciated that coordinated control according to embodiments of the present invention is not limited to use of antenna patterns having the same or similar attributes at the various base stations. Accordingly, antenna beams having various attributes (e.g., wide beams and narrow beams, beams having different azimuthal orientations, etcetera) may be used by the base stations under control of coordinated controller 260 during a same epoch.

Although the embodiment illustrated in FIG. 4 shows the use of substantially non-overlapping antenna patterns, it should be appreciated that embodiments of the present invention may utilize overlapping antenna patterns, non-overlapping antenna patterns, and combinations thereof. According to one embodiment, wide beam antenna patterns are utilized in combination with narrow beam antenna patterns, wherein the wide beam antenna patterns substantially overlap one or more narrow beam antenna pattern. For example, a subscriber station may be moving relatively rapidly within service area 121, thus suggesting selection of an antenna pattern having a wider beam width, although the subscriber station may also be within the coverage area of an antenna pattern having a more narrow beam width. Similarly, a subscriber station may be communicating data infrequently, although moving relatively slowly within service area 321, also suggesting selection of an antenna pattern having a wider beam width although the subscriber station may also be within the coverage area of an antenna pattern having a more narrow beam width. For example, although the subscriber station may be moving slowly, because data traffic to/from the subscriber station is infrequent (e.g., long periods of time transpire between data traffic associated with the subscriber station) the subscriber station's position may have changed significantly between transmissions associated with that subscriber station. The use of such wide beam, antenna patterns may be provided in order to avoid the subscriber station's movement from rendering the antenna pattern selection untimely, invalid, or unsatisfactory.

It should thus be appreciated that selection of an antenna pattern, for providing communications with respect to a particular subscriber station may be based upon criteria in addition to the aforementioned antenna pattern feedback information. For example, controller 240 of base station 111 may utilize information with respect to the velocity of a subscriber station, the direction of movement of the subscriber station, the location of the subscriber station, the frequency or in frequency of a subscriber station's communications, etcetera in identifying, a best antenna pattern for use with respect to any particular-subscriber station.

From the above it can be appreciated that embodiments of the invention may utilize subgroups of antenna patterns within the antenna patterns selected for scanning. For example, a first subgroup comprising narrow beam antenna patterns to be used in providing communications with subscriber stations having one or more particular attributes (e.g., stationary subscriber stations or slow moving subscriber stations with frequent communications) and a second subgroup comprising wide beam antenna patterns to be used in providing communications with subscriber stations having one or more different particular attributes (e.g., fast moving subscriber stations or slow moving subscriber stations with infrequent communications) may be utilized. Antenna patterns within and between these groups may be overlapping, non-overlapping, or combinations thereof.

Having perfect channel state information available with respect to each of the subscriber stations would facilitate adaptively forming ideal antenna patterns for communications therewith. However, it is often not possible or practicable to have perfect or even near perfect channel state information. For example, latency with respect to collecting and processing channel state information often renders the channel state information unsatisfactory. Moreover, the overhead necessary to provide feedback and processing of such information can be burdensome. Accordingly, as described above, embodiments of the present invention forego attempts to collect and process perfect channel state information and to create antenna patterns uniquely optimized for a particular subscriber station's channel state. Scanning predefined antenna patterns according to embodiments of the present invention is expected to provide a very good approximation of the use of antenna patterns uniquely optimized for particular subscriber stations where the number of subscriber stations is large and nearly equally distributed. However, it is expected that embodiments of the present invention will, be utilized where there are relatively few subscriber stations and/or where the subscriber stations are unequally distributed.

Accordingly, selection of the plurality of directional antenna patterns used by a base station is preferably adjusted from time to time, such as based upon environment, usage patterns, etcetera. Continuing with the example of FIG. 4, the selection of antenna patterns 411-414, initially selected for scanning, may be revised over time based upon historical information, environmental factors, operational goals, etcetera. For example, it may be discovered that subscriber stations are rarely disposed in the north-west and south-west quadrants of base station 111 (antenna patterns 414 and 411, respectively). Accordingly, it may be decided that scheduling multiple antenna patterns to service these areas is inefficient. Controller 240 of embodiments of the present invention may thus access database 243 to obtain an antenna pattern configuration or configurations more suited to the scenario being experienced. Moreover, it may be determined that the north-east quadrant of base station 111 (antenna pattern 413) has the greatest subscriber station activity and/or has a subscriber station disposed therein for which a high quality of service is required. Accordingly, controller 240 of embodiments of the invention may thus additionally or alternatively access database 243 to obtain antenna pattern configurations more suited to this scenario.

Figure 5:
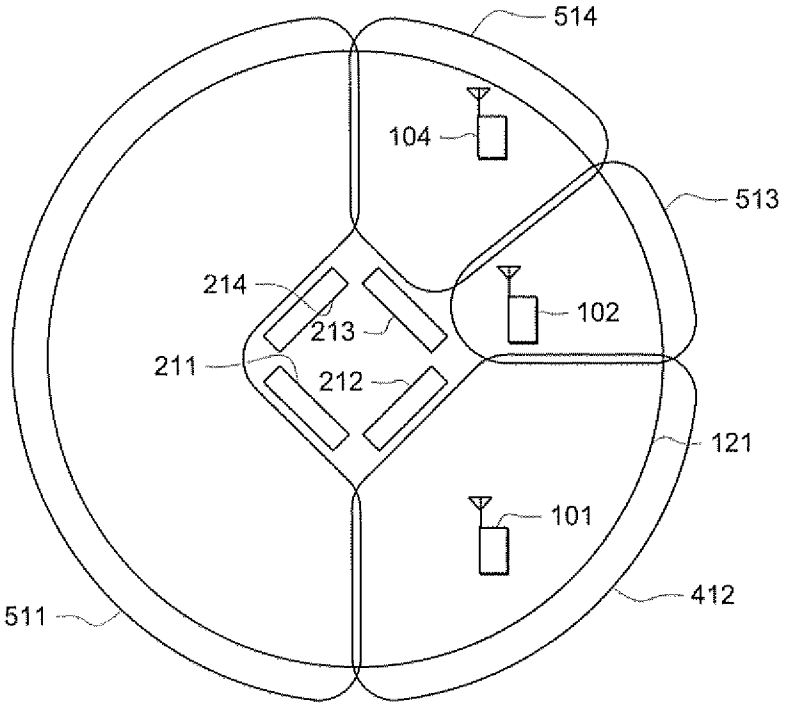
FIG. 5 shows an exemplary revised set of antenna patterns selected for scanning according to an embodiment of the invention.

Referring now to FIG. 5, selection of an alternative set of antenna patterns for scanning in accordance with the activity scenarios described above is shown. Specifically, although antenna pattern 412 continues to be utilized to service the south-east quadrant, antenna patterns 411 and 414 have been replaced with antenna pattern 511 and antenna pattern 413 has been replaced with antenna patterns 513 and 514. Antenna pattern 511 provides a wide beam antenna pattern suited for serving the western half of the service area because, in this example, subscriber stations are rarely disposed in that area. Thus time in the scanning sequence dedicated to this seldom used area may be minimized. Antenna pattern 514 provides a more narrow beam antenna pattern consistent with the higher utilization of the corresponding portion of service area 121 in this example. Antenna pattern 513 of this example provides an even more narrow beam antenna pattern, such as may be associated with subscriber station 102 having a high quality of service requirement and/or the corresponding portion of service area 121 having a high utilization density. The foregoing antenna patterns, adjusted over time according to embodiments of the present invention, are expected to provide a very good approximation of the use of antenna patterns uniquely optimized for particular subscriber stations where the number of subscriber stations is large and nearly equally distributed.

Although the embodiments illustrated in FIGS. 4 and 5 include a same number of antenna patterns, it should be appreciated that there is no limitation that there be a same number (or any particular number) of antenna patterns selected for scanning. For example, embodiments of the present invention may initially implement a first number of antenna patterns in scanning and thereafter increase or decrease the number of antenna patterns used in scanning.

It should be appreciated that the foregoing antenna patterns utilized with respect to traffic payload communication may not be the only antenna patterns utilized by base stations of embodiments of the invention. For example, subscriber stations outside of a particular antenna patterns may not receive communications from the base station when communications are transmitted using one or more antenna patterns other than a best antenna pattern for the subscriber station. Accordingly, base stations of the present invention may be adapted to provide antenna patterns for pilot, control, and/or timing signals which may be received by subscriber stations independent of the antenna patterns selected for scanning. For example, an omni-directional antenna pattern may be utilized with respect to a pilot signal to provide frame timing information and/or other control information utilized by subscriber stations. Additionally or alternatively, timing information and/or other control information may be included in signals transmitted using the antenna patterns selected for scanning.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method comprising:

selecting a plurality of antenna patterns from a group of available antenna patterns;

identifying a respective antenna pattern of said plurality of antenna patterns for traffic channel communication with each of a plurality of stations by scanning said plurality of antenna patterns, wherein said identifying a respective antenna pattern of said plurality of antenna patterns for a particular station of said plurality of stations comprises:

receiving antenna pattern choice information generated by said particular station from monitoring operation of said plurality of antenna patterns, wherein said antenna pattern choice information identifies a perceived best antenna pattern;

using said antenna pattern choice information and at least one other parameter to identify a preferred antenna pattern of said plurality of antenna patterns for use with respect to said particular station, wherein said at least one other parameter is derived from an operational characteristic of said particular station during communication with said particular station using at least one antenna pattern of said plurality of antenna patterns;

scheduling a scanning order for the identified antenna patterns of said plurality of antenna patterns;

scanning the identified antenna patterns of said plurality of antenna patterns according to said scanning order to provide traffic channel communications with said plurality of stations; and using a traffic channel to communicate with one or more station of said plurality of stations when a respective antenna pattern of said plurality of antenna patterns is being scanned.

2. The method of claim 1, wherein said selecting a plurality of antenna patterns comprises:

selecting an initial plurality of antenna patterns based upon an expected operational environment.

3. The method of claim 1, wherein said selecting a plurality of antenna patterns comprises:

revising a previous selection of a plurality of antenna patterns based upon actual operational environment conditions.

4. The method of claim 1, wherein said plurality of antenna patterns comprise a plurality of directional antenna patterns which collectively provide complete illumination of a base station service area.

5. The method of claim 1, wherein said identifying a respective antenna of said plurality of antenna patterns comprises:

transmitting, by said plurality of stations, said antenna pattern choice information.

6. The method of claim 5, wherein said antenna pattern choice information identifies an antenna pattern perceived by a respective station as a best choice for use in communicating said traffic channel.

7. The method of claim 5, wherein said identifying a respective antenna pattern of said plurality of antenna patterns comprises:

implementing a ranging protocol for obtaining said antenna pattern choice information.

8. The method of claim 1, wherein said at least one other parameter is a parameter selected from the group consisting of:

a velocity metric associated with said station;

a direction of movement metric associated with said station; and a frequency of communication metric associated with said station.

9. The method of claim 1, wherein said identifying a respective antenna pattern of said plurality of antenna patterns comprises:

identifying a same antenna pattern of said plurality of antenna patterns to provide traffic channel communication with two stations of said plurality of stations which are disposed at different geographic locations.

10. The method of claim 1, wherein said identifying a respective antenna pattern of said plurality of antenna patterns comprises:

identifying two different antenna patterns of said plurality of antenna patterns to provide traffic channel communication with two stations of said plurality of stations which are disposed at a same geographic location.

11. The method of claim 1, wherein said scheduling a scanning order comprises:

scheduling a quasi-random scanning order.

12. The method of claim 1, wherein said scheduling a scanning order comprises:

scheduling a sequential scanning order.

13. The method of claim 1, wherein said scheduling a scanning order comprises:

scheduling a weighted scanning order.

14. The method of claim 1, wherein said scheduling a scanning order comprises:

establishing said scanning order to provide a desired quality of service with respect to at least one station of said plurality of stations.

15. The method of claim 1, wherein said scheduling a scanning order comprises:

establishing different illumination times for antenna patterns of said plurality of antenna patterns.

16. The method of claim 15, wherein said antenna pattern illumination times are proportional to communication traffic distribution within a service area illuminated by a corresponding said plurality of antenna pattern.

17. The method of claim 1, wherein said scheduling a scanning order comprises:

establishing an illumination frequency for at least one antenna pattern of said plurality of antenna patterns which is greater than an illumination frequency for other antenna patterns of said plurality of antenna patterns.

18. The method of claim 1, wherein said scheduling a scanning order comprises:

establishing said scanning order to minimize intra-network interference.

19. The method of claim 18, wherein said establishing said scanning order comprises:

analyzing information with respect to a plurality of base stations in said network.

20. The method of claim 18, wherein said establishing said scanning order comprises:

coordinating scanning orders of a plurality of base stations.

21. The method of claim 1, wherein said scanning said plurality of antenna patterns comprises:

forming said plurality of antenna patterns for processing antenna beam signals in said scanning order.

22. The method of claim 1, wherein said selecting a plurality of antenna patterns, said identifying a respective antenna pattern of said plurality of antenna patterns, said scheduling a scanning order, and said scanning said plurality of antenna patterns are performed by a wireless base station.

23. The method of claim 1, wherein said traffic channel communications are provided according to a wireless network protocol.

24. The method of claim 1, wherein said wireless network protocol is selected from the group consisting of:

an IEEE 802.11 protocol; and an IEEE 802.16 protocol.

25. The method of claim 1, wherein said plurality of stations comprise subscriber stations.

26. A method comprising:

forming a plurality of antenna patterns for each base station of a plurality of base stations for processing antenna beam signals in a respective scanning order;

receiving antenna pattern choice information generated by stations of a plurality of stations from monitoring operation of said plurality of antenna patterns, wherein said antenna pattern choice information identifies a perceived best antenna pattern of the plurality of antenna patterns for a respective station;

using respective said antenna pattern choice information to identify a preferred antenna pattern of said plurality of antenna patterns for use with respect to each station of said plurality of stations;

scanning the identified preferred antenna patterns of said plurality of antenna patterns according to scanning sequences implemented by the plurality of base stations to provide traffic channel communications with said plurality of stations;

providing traffic channel communications for said plurality of stations using the identified preferred antenna patterns when a respective preferred antenna pattern of said plurality of antenna patterns is being scanned, said antenna patterns for each said base station being formed for processing antenna beam signals in a respective scanning sequence; and coordinating said scanning sequences of said plurality of base stations using said antenna patterns to minimize intra-network interference.

27. The method of claim 26, wherein at least one scanning sequence of said respective scanning sequences comprises a quasi-random scanning order.

28. The method of claim 26, wherein at least one scanning sequence of said respective scanning sequences comprises a sequential scanning order.

29. The method of claim 26, wherein at least one scanning sequence of said respective scanning sequences comprises a weighted scanning order.

30. The method of claim 26, further comprising:

establishing at least one scanning sequence of said respective scanning sequences to provide a desired quality of service with respect to at least one station of said plurality of stations.

31. The method of claim 26, further comprising:

establishing said respective scanning sequences as a function of antenna pattern choice information provided by said plurality of stations.

32. The method of claim 31, wherein said antenna pattern choice information identifies an antenna pattern perceived by a respective station as a best choice for use in communicating said traffic channel.

33. A method comprising:

selecting an initial plurality of antenna patterns from a group of available antenna patterns, wherein said selecting an initial plurality of antenna patterns comprises selecting a plurality of antenna patterns which collectively provide complete illumination of a desired service area, wherein the antenna patterns making up said plurality of antenna patterns are selected based upon one or more assumed environmental conditions;

scanning said selected initial plurality of antenna patterns according to a scanning sequence to provide traffic channel communications with a plurality of stations;

selecting a revised revising said selected initial plurality of antenna patterns from said group of available antenna patterns based upon actual operational environment conditions monitored during said scanning said plurality of antenna patterns to provide a revised plurality of antenna patterns, said revised plurality of antenna patterns being selected from said group of available antenna patterns; and selecting a sequence for scanning said revised plurality of antenna patterns to provide a desired quality of service (QoS) with respect to one or more station of the plurality of stations; and scanning said revised plurality of antenna patterns according to said scanning sequence to provide traffic channel communications with said plurality of stations having said QoS with respect to one or more station of the plurality of stations, wherein a sequence of said scanning said revised plurality of antenna patterns is selected to provide a desired quality of service (QoS) with respect to one or more station of the plurality of stations.

34. The method of claim 33, wherein said one or more assumed environmental conditions comprise an even distribution of said stations.

35. The method of claim 33, wherein said one or more assumed environmental conditions comprise a statistically large number of stations, wherein said statistically large number is a number sufficient to result in scanning using said plurality of antenna patterns providing operational performance meeting that of a base station using antenna patterns uniquely formed for each station using channel state information.

36. The method of claim 33, wherein said one or more assumed environmental conditions comprise said plurality of stations being homogenous.

37. The method of claim 33, wherein said revising said selected initial plurality of antenna patterns comprises:

selecting wider beam antenna patterns for illuminating portions of a service area having lesser communication traffic.

38. The method of claim 33, wherein said revising said selected initial plurality of antenna patterns comprises:

selecting wider beam antenna patterns for illuminating portions of a service area having higher velocity stations disposed therein.

39. The method of claim 33, wherein said revising said selected initial plurality of antenna patterns comprises:

selecting narrower beam antenna patterns for illuminating portions of a service area having greater communication traffic.

40. The method of claim 33, wherein said revising said selected initial plurality of antenna patterns comprises:

selecting narrower beam antenna patterns for illuminating portions of a service area having a station requiring a high quality of service.

41. The method of claim 33, wherein said revising said selected initial plurality of antenna patterns comprises:

selecting a plurality of overlapping antenna patterns for at least a portion of a service area.

42. The method of claim 33, wherein said revising said selected initial plurality of antenna patterns comprises:

selecting a plurality of non-overlapping antenna patterns for at least a portion of a service area.

43. The method of claim 33, wherein said revising said selected initial plurality of antenna patterns comprises:

selecting a combination of overlapping and non-overlapping antenna patterns.

44. The method of claim 33, further comprising:

identifying a respective antenna pattern of said initial plurality of antenna patterns for traffic channel communication with each of a plurality of stations.

45. The method of claim 44, further comprising:

identifying a respective antenna pattern of said revised plurality of antenna patterns for traffic channel communication with each of a plurality of stations.

46. A system comprising:

an antenna array;

a beam former coupled to said antenna array;

a transceiver coupled to said beam former and in communication with said antenna array through said beam former;

an antenna pattern controller coupled to said beam former and operable to control said beam former to provide a plurality of antenna patterns for communicating traffic channel signals associated with said transceiver; and a scheduler coupled to said antenna pattern controller and said transceiver, said scheduler being operable to receive antenna pattern choice information generated by stations from monitoring operation of antenna patterns of said plurality of antenna patterns wherein said antenna pattern choice information identifies a perceived best antenna pattern by a respective station, said scheduler further being operable to scan identified antenna patterns of said plurality of antenna patterns according to a scanning order to provide traffic channel communications with said stations, and said scheduler further being operable to coordinate use of one or more traffic channel to communicate with one or more station of said plurality of stations when a respective antenna pattern of said plurality of antenna patterns is being scanned.

47. The system of claim 46, wherein said beam former comprises a phase shifter network.

48. The system of claim 46, wherein said beam former comprises a digital beam former circuit.

49. The system of claim 46, wherein said antenna array comprises:

a plurality of individual antenna elements which, when coupled to said beam former, provide a phased array.

50. The system of claim 46, wherein said antenna array comprises: a plurality of antenna panels.

51. The system of claim 46, wherein said transceiver comprises: a transceiver operable to provide wireless local area network communications.

52. The system of claim 46, wherein said transceiver comprises:

a transceiver operable to provide communications in accordance with at least one of an IEEE 802.11 protocol and an IEEE 802.16 protocol.

53. The system of claim 46, further comprising:

a database of antenna patterns available for use, wherein said plurality of antenna patterns are selected from said database of antenna patterns.

54. The system of claim 46, further comprising:

control logic in communication with said antenna pattern controller and said scheduler, said control logic being operable to revise a selection of antenna patterns forming said plurality of antenna patterns.

55. The system of claim 46, further comprising:

coordinated control logic in communication with said scheduler, said coordinated control logic being operable to coordinate scheduling of antenna pattern scanning sequences for a plurality of base stations to minimize inter-network interference.

56. The system of claim 46, further comprising:

a second antenna array; and a second beam former coupled to said second antenna array, wherein said transceiver is in communication with said second antenna array through said second beam former.

57. The system of claim 56, wherein said antenna array and said second antenna array provide diversity signals with respect to said transceiver.

58. The system of claim 56, wherein said antenna array and said second antenna array provide multiple-input-multiple-output signals with respect to said transceiver.

59. The system of claim 46, wherein said antenna array and said beam former are provided in a housing separate from said transceiver.

60. The system of claim 46, wherein said antenna array, said beam former, said transceiver, said antenna pattern controller, and said scheduler are provided in a same housing.

* * * * *

UNITED STATES PATENT AND TRADEMARK OFFICE

CERTIFICATE OF CORRECTION

PATENT NO. : 8,548,525 B2
APPLICATION NO. : 11/770559
DATED : October 1, 2013
INVENTOR(S) : Piu B. Wong et al.

It is certified that error appears in the above-identified patent and that said Letters Patent is hereby corrected as shown below:

In the Specification:

At column 2, line number 63, delete “sendee” and replace with --service--.
At column 3, line number 40, delete “sendee” and replace with --service--.
At column 3, line number 46, delete “lime” and replace with --time--.
At column 3, line number 47, delete “seizing” and replace with --serving--.
At column 5, line number 45, delete “210,” and replace with --210.--.
At column 5, line number 46, delete “path,” and replace with --path--.
At column 5, line number 55, delete “digital,” and replace with --digital--.
At column 8, line number 13, delete “pay load” and replace with --payload--.
At column 8, line number 55, delete “throughput.” and replace with --throughput,--.
At column 9, line number 20, delete “succession,” and replace with --succession--.
At column 9, line number 28, delete “control,” and replace with --control--.
At column 10, line number 8, delete “sendee” and replace with --service--.
At column 11, line number 4, delete “313” and replace with --113--.
At column 11, line number 35, delete “321” and replace with --121--.
At column 11, line number 45, delete “beam,” and replace with --beam--.
At column 11, line number 50, delete “pattern,” and replace with --pattern--.
At column 11, line number 56, delete “in frequency” and replace with --infrequency--.
At column 11, line number 58, delete “identifying,” and replace with --identifying--.
At column 11, line number 59, delete “particular-subscriber” and replace with --particular subscriber--.
At column 12, line number 27, delete “will,” and replace with --will--.

Signed and Sealed this
Seventh Day of January, 2014

Margaret A. Focarino

Margaret A. Focarino
*Commissioner for Patents of the United States Patent and Trademark Office*

UNITED STATES PATENT AND TRADEMARK OFFICE

CERTIFICATE OF CORRECTION

PATENT NO. : 8,548,525 B2
APPLICATION NO. : 11/770559
DATED : October 1, 2013
INVENTOR(S) : Wong et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1737 days.

Signed and Sealed this
Third Day of March, 2015

Michelle K. Lee

Michelle K. Lee
*Deputy Director of the United States Patent and Trademark Office*